United States Patent [19]

Fikkers

[11] 4,190,920

[45] Mar. 4, 1980

[54] GARBAGE CHUTE CLEARING DEVICE

[76] Inventor: John T. Fikkers, 805 Rosita Rd., Pacifica, Calif. 94044

[21] Appl. No.: 31,186

[22] Filed: Apr. 18, 1979

[51] Int. Cl.[2] ..... B08B 9/02

[52] U.S. Cl. ..... 15/104.05; 15/104.3 R; 15/105; 15/236 R; D8/13; 294/61

[58] Field of Search ..... 15/104 R, 104.05, 104.16, 15/104.3 R, 104.3 G, 105, 236 R, 242; 294/61; D8/13; 56/400.12, 400.16, 400.21; 7/114, 115

[56] References Cited

U.S. PATENT DOCUMENTS

| | | | |
|---|---|---|---|
| 252,738 | 1/1882 | Chesbro | 15/104.05 |
| 1,758,555 | 5/1930 | Bettex et al. | 7/115 |
| 3,205,517 | 9/1965 | Hinrichs | 15/104 R |

*Primary Examiner*—Edward L. Roberts
*Attorney, Agent, or Firm*—Alfons Puishes

[57] ABSTRACT

A device for clearing plugged garbage chutes is specially constructed to make it adaptable for use in multistory buildings, such as apartment houses, having vertical chutes extending through several stories down to a receptacle in the basement of the building. The clogging of these chutes is generally caused by an accumulation of old newspapers, shopping bags and other large pieces of paper. A device of generally Tee-shaped configuration comprises a series of sharp pointed cutting edges positioned on the cross of the Tee and grabbing arms at either end. An extensible handle comprises the vertical portion of the Tee which in turn is comprised of relatively short sections which may be coupled together to facilitate insertion into the chute to varying elevations. A removable handle is positioned at the lower end of the Tee to permit rotation of the device to effect cutting through the obstruction and pulling out the obstructing material.

4 Claims, 3 Drawing Figures

GARBAGE CHUTE CLEARING DEVICE

BACKGROUND OF THE INVENTION

Vertical garbe chutes which extend down through several stories of an apartment house for disposal of refuse to a receptacle in the basement of the building are in common use. These often become clogged and inoperable making it necessary for them to be cleared. I have found that the cause of the clogging is primarily that resulting of stuffing of old newspapers, shopping bags, and other large paper items into the chute which do not permit free passage. This necessitates calling a maintenance man to insert probes of various kinds into the chute in an effort to clear the material. This is particularly troublesome in a multi-storied building where the clogging may occur a considerable distance from the bottom outlet of the chute.

I have found nothing in the prior art which is constructed to facilitate this operation. The prior pertinent patent art as known to me at present is set forth briefly below.

Miller U.S. Pat. No. 179,718 discloses a Tee-shaped handle device constructed for picture hanging and carpet stretching which resembles my invention in appearance only but does not have any of the cutting or clearing features which I have.

U.S. Pat. No. 2,017,369 to McGhee features a fire hook which comprises a sharp cutting hook on the end of a handle and is constructed to be used by fire fighters in tearing away portions of the ceilings of a room in connection with their activities in fighting fire. It does not teach my rotating and grabbing elements, nor the extensible handle.

U.S. Pat. No. 2,724,610 to Fitzgerald does disclose an extensible handle having hinged or telescoping sections and a Tee-shaped golf ball retriever on one end. It is in effect a long handled rake capable of being folded up and placed into a golf bag, the working end of the Tee being constructed to retrieve golf balls. It does not suggest any use or modification for the purpose which I disclose herein.

U.S. Pat. No. 3,936,088 to Williams likewise teaches a handle having a series of hinged sections with a double-ended hook on one end adapted for placing or removing tarpalins over the top of a vehicle by the operator working from the ground. It likewise does not suggest the construction of my device and in no way could it be modified to perform the functions which I do.

SUMMARY OF THE INVENTION

I have invented a device which has been well received by building maintenance people as filling a long felt need in clearing clogged garbage chutes from obstructions, principally of accumulations of newspapers and the like. My device is generally a Tee-shaped probe. The top or working end of my Tee is equipped with a series of sharp pointed forwardly facing cutting elements and a pair of oppositely facing grasping arms or hooks positioned at opposite ends of the top of the Tee. The vertical part of the Tee comprises a plurality of sections which are relatively of short length and may be coupled together to provide any desired length. In fact, at the end of my Tee opposite the working end I have provided a handle also of Tee-shaped configuration which may be coupled into the last extensible section and disposed to permit forcing my device into the chute and rotating it. This effects the operation of the sharp pointed cutting edges in penetrating through the obstruction and in assisting the pulling out of the cut up sections of obstructed material with the aid of the grasping arms.

The device may be used by insertion into the chute from its bottom outlet vertically upwards or downwards into the chute through the disposal openings as set forth more fully in the description which follows.

DESCRIPTION OF A PREFERRED EMBODIMENT

Figure 1:
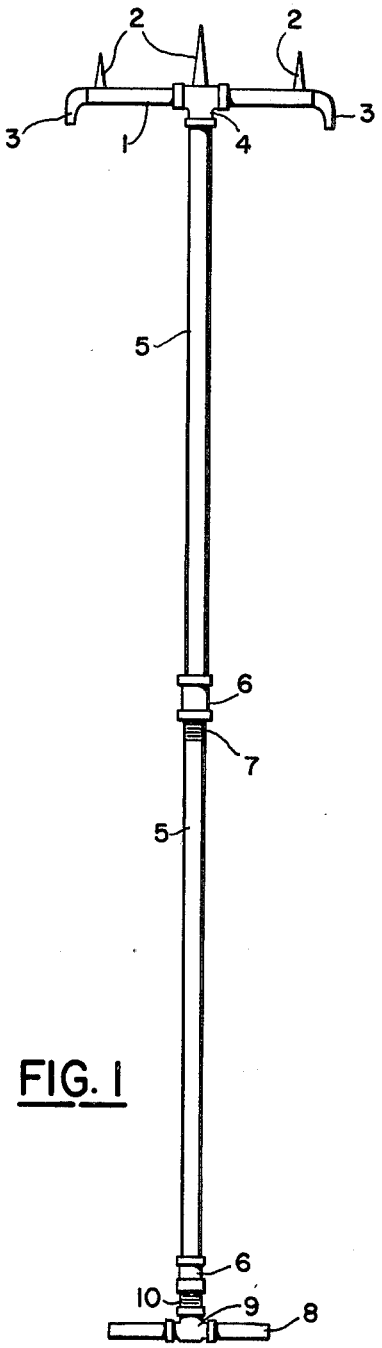
FIG. 1 is an elevation view of the device of my invention.

Referring now more particularly to FIG. 1, there is seen the horizontal clearing arm 1 upon which is positioned projecting outwardly the pointed members 2, having sharp cutting edges. On opposite ends of arm 1 are positioned grasping arms 3 which are faced in a direction opposite to that of the sharp cutting points 2. I may construct my device completely from pipe materials and fittings in which case I utilize a Tee 4 in which opposite ends of the arm 1 may be screwed. In that event the grasping arms 3 may comprise elbows which screw on to arm 1. Operating arm 5 which may also be of pipe material is then screwed into the Tee 4. On the opposite end of arm 5 is positioned a coupling 6 which may be threaded onto arm 5 by means of threads 7. Successive sections of my operating arm 5 may be coupled together as shown in sections, each section being of the order of magnitude of 42 inches in length for reasons set forth below.

On the opposite ennd of the most remote section of arm 5 having its coupling 6 and threaded section 7, is positioned the operating handle 8. This may also be made of pipe material and fittings having a Tee section 9 and a nipple 10 inserted into coupling 6.

As thus assembled the effective operation of my device will be clear.

Figure 2:
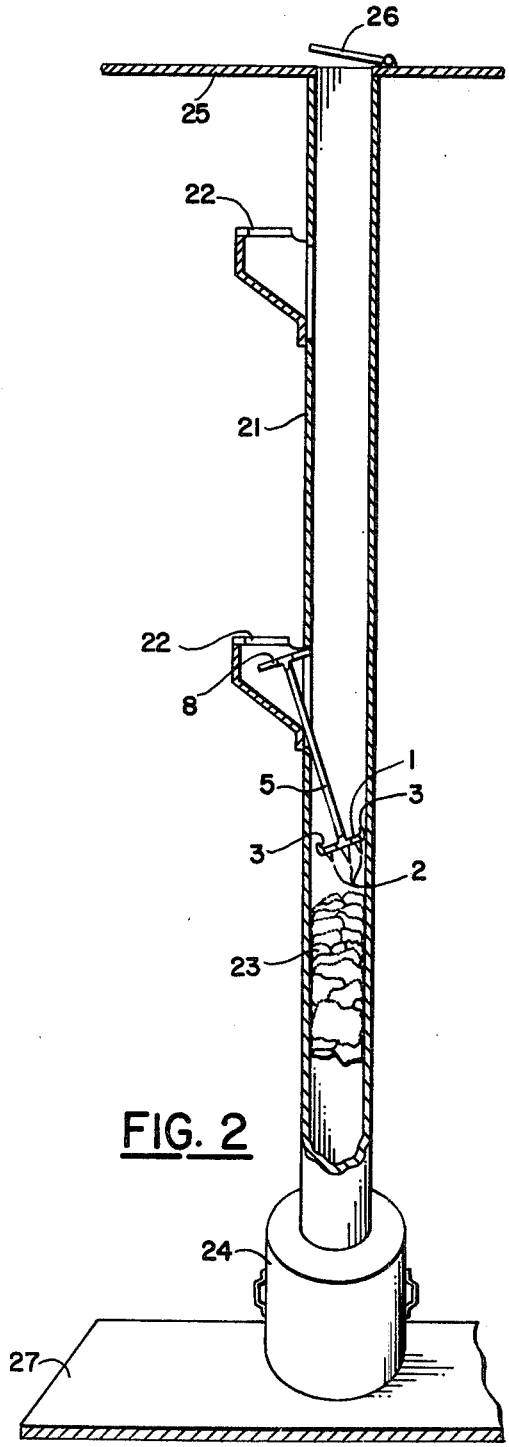
FIG. 2 is a diagrammatic view of a garbage chute situated in a building showing the operation of my device from above.

By reference to the figures and especially now to FIG. 2, there is seen a vertical garbage chute 21 with disposal openings 22 located at each floor in a building. In the case shown, an obstruction of old newspapers is shown at 23 which has clogged the chute just below disposal opening 22.

The receptacle or garbage can for the building 24 is shown at the bottom of the chute 21. The building roof is indicated at 25 and the cover over the chute at 26. The basement of the building on the floor of which 27 is positioned the garbage can 24.

In the illustration shown in FIG. 2, the clogged section 23 is shown in relatively close proximity to disposal opening 22. In this case my device may be inserted through the disposal opening until clearing arm 1 engages the clogging material. Sharp cutting edge points 2 are then forced into the material by use of operating handle 8 and the device rotated also by use of the handle 8. This action tends to cut up the clogging materials which may be pulled back up through disposal opening 22 by the action of grasping arms 3. When sufficient material has been removed, further action of my device will effect forcing of the remainder of the clogging material 23 down through chute 21 and into receptacle 24.

Figure 3:
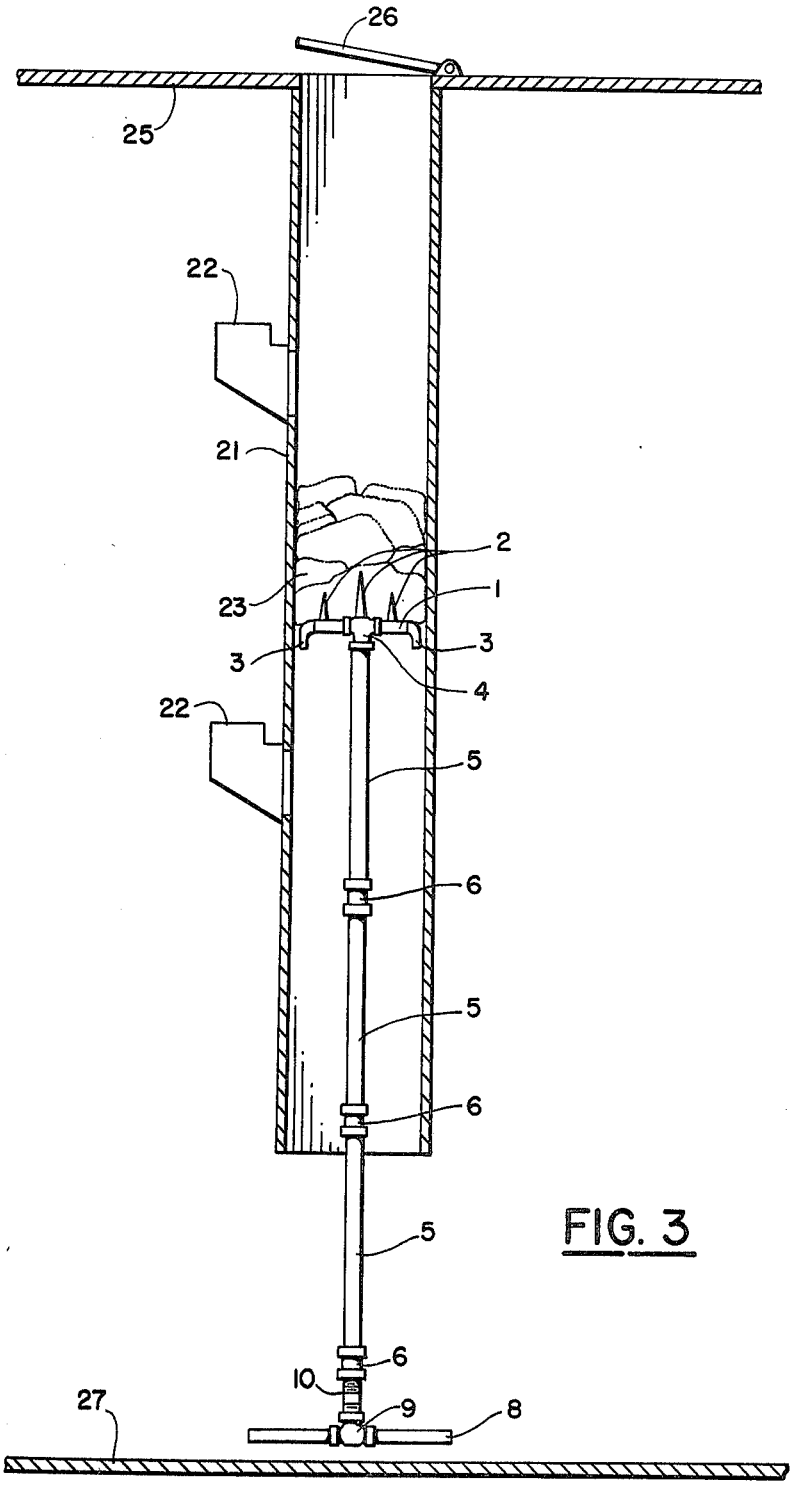
FIG. 3 is a diagrammatic view of a garbage chute in a building showing the operation of my device from below.

Referring now to FIG. 3 there is shown the more difficult situation when the obstructing or clogging material 23 is located a considerable distance above a disposal chute. In this case garbage receptacle 24 is removed and my device inserted upwards into the chute. It is in this operation that my successive sections of arm 5 are used by coupling them together as the device is inserted upwardly into the chute. It is now evident that the sections of arm 5 must be no longer than the clearance between the bottom of the chute 21 and the basement floor 27 which approximates the height of the garbage can which has been removed which is usually of the order of magnitude of 42 inches, as disclosed above.

When a sufficient number of sections of arm 5 have been jointed together to reach the obstructing material 23 the device is forced into the material by use of handle 8 and rotated as described above. The action of the sharp pointed cutting edges 2 will be to cut into the obstructing material as described above and by pulling downwards on handle 8, the grasping arms 3 will cause the material to be forced downward and out of the chute, thus clearing the obstruction.

While I have described my device to be constructed of pipe and pipe fittings, any suitable construction may be used, such as solid rods having threaded connections and detachable connections between sections of operating arm 5. I may construct my device of aluminum, copper, as well as steel, whichever is most available and convenient. For example, I have found half inch copper tubing to be quite satisfactory for my operating and cleaning arms of my device.

The detachable sections of operating arm 5 provide a feature which also makes it convenient to transport my device from one location for use in another.

I claim:

1. A garbage chute clearing device of generally "T"-shaped configuration comprising:

a vertical member;

a horizontal member positioned upon one end of said vertical member at ninety degrees thereto and forming a "T"-shape therewith;

a plurality of sharp pointed cutting members positioned upon and protruding upwardly above said horizontal member;

a pair of hook-shaped grasping members positioned on opposite ends of said horizontal member and pointing downward in a direction opposite that of said sharp-pointed members;

a handle positioned on the end of said vertical member opposite said horizontal member;

said handle being disposed for forcing said device into said chute while imparting a combined motion of rotation and translation to said device.

2. The device of claim 1 in which said vertical member is comprised of a plurality of separate sections;

means for connecting said separate sections to each other to form a single elongated member;

means for disconnecting said separate sections from each other.

3. The device of claim 2 in which said vertical member, said horizontal member and said handle are comprised of sections of standard hollow pipe said members and said handle being joined together by means of standard screwed pipe fittings.

4. The device of claim 3 in which said standard pipe comprises standard hollow copper tubing said copper tubing being jointed together by means of standard tubing connecting fittings.

* * * * *